US008677710B2

(12) United States Patent
Williams et al.

(10) Patent No.: US 8,677,710 B2
(45) Date of Patent: Mar. 25, 2014

(54) ROOFING TILE FASTENING SYSTEM

(76) Inventors: John M. Williams, Wells, VT (US); Robert B. Williams, Poultney, VT (US)

( * ) Notice: Subject to any disclaimer, the term of this patent is extended or adjusted under 35 U.S.C. 154(b) by 0 days.

(21) Appl. No.: 13/819,192

(22) PCT Filed: Oct. 28, 2011

(86) PCT No.: PCT/US2011/058327

§ 371 (c)(1),
(2), (4) Date: Feb. 26, 2013

(87) PCT Pub. No.: WO2012/148453

PCT Pub. Date: Nov. 1, 2012

(65) Prior Publication Data

US 2013/0160388 A1 Jun. 27, 2013

Related U.S. Application Data

(60) Provisional application No. 61/517,681, filed on Apr. 25, 2011, provisional application No. 61/490,134, filed on May 26, 2011.

(51) Int. Cl.
*E04D 1/34* (2006.01)

(52) U.S. Cl.
USPC ..... 52/551; 52/548; 52/478

(58) Field of Classification Search
USPC ..... 52/547, 551, 478, 498.1, 548, 748.1, 52/543
See application file for complete search history.

(56) References Cited

U.S. PATENT DOCUMENTS

| | | | | | |
|---|---|---|---|---|---|
| 623,988 | A * | 5/1899 | Contant | 52/26 |
| 676,579 | A * | 6/1901 | Esselen | 52/26 |
| 4,217,853 | A * | 8/1980 | Davitz | 118/500 |
| 5,531,334 | A * | 7/1996 | Forby | 211/119 |
| 5,642,596 | A | 7/1997 | Waddington | |
| 6,125,592 | A * | 10/2000 | Hickey et al. | 52/543 |
| 7,448,177 | B2 * | 11/2008 | McClintick | 52/551 |
| 8,033,072 | B2 * | 10/2011 | McClintick | 52/551 |
| 8,215,070 | B2 * | 7/2012 | Railkar et al. | 52/173.3 |

* cited by examiner

*Primary Examiner* — Jeannette E Chapman
*Assistant Examiner* — Daniel Kenny
(74) *Attorney, Agent, or Firm* — Lawrence J. Shurupoff

(57) ABSTRACT

A roofing tile installation system includes spaced rows of installation strips each having an elongated base to which is attached a plurality of spaced apart hooks. The hooks are formed with a profile that engages and presses on underlying tiles and that grips and hooks around the lower edge of an overlying tile. Each tile is positioned and held laterally between a pair of hooks and held vertically on the slope of a roof by a single hook. An improved weatherproofing system includes a second layer of water resistive material which protects an underlying layer of plastic weatherproofing material against exposure to sunlight and erosion from wind and rain.

9 Claims, 16 Drawing Sheets

ROOFING TILE FASTENING SYSTEM

BACKGROUND AND SUMMARY

Slate roofs are highly desirable from both an aesthetic and a functional viewpoint. The proper installation of a slate roof requires a skilled and experienced slate roofer. Unfortunately, there is a scarcity of experienced slate roofers. This scarcity has led to hesitancy on the part of some architects and home builders to specify and install slate roofs, knowing that there are few craftsmen available to properly install slate roofs. Moreover, the scarcity of qualified skilled slate roofers has driven up the installation cost.

A need therefore exists for a method and system for installing slate roofs which do not require experienced slate roofers, and which can be practiced by virtually any roofer with a minimal amount of instruction.

The present disclosure provides a method and system which not only satisfies the needs noted above, but also facilitates and expedites the installation of slate roofs by roofers having no prior experience with slate roof installation. These ends are achieved with installation strips that can be installed quickly and easily by hand (hammer and nail) or by mechanically assisted means such as by a nail gun.

Previously, a slate roofer required a "feel" for applying the proper amount of hammer driving force needed to properly install a slate shingle by hammer and nail. This "feel" is no longer required with the slate installation system described herein. In one embodiment, other than along the border of a roof, an installer can pound installation nails as hard as possible without causing damage to the slate roofing tiles. This reduces waste, eliminates scrapped and damaged tiles due to installation damage, reduces material costs by reducing the number of tiles required and reduces installation time, all while potentially using lower cost roofing labor.

BRIEF DESCRIPTION OF THE DRAWINGS

In the various views of the drawings, like reference numerals designate like or similar parts.

DESCRIPTION OF REPRESENTATIVE EMBODIMENTS

Figure 1:
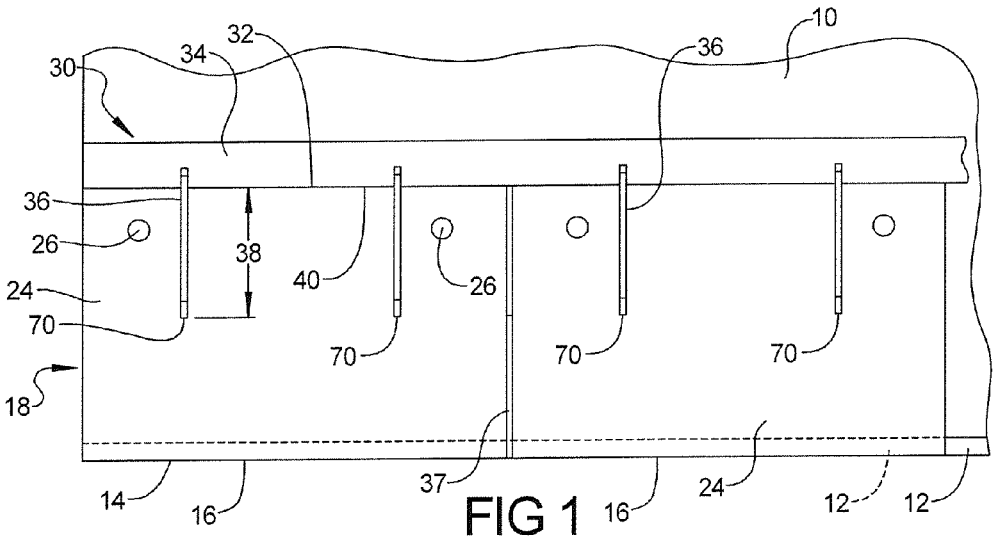
FIG. 1 is a partial top plan view of a first row or course of slate roofing tiles installed on a roof in accordance with the disclosure.
Figure 7:
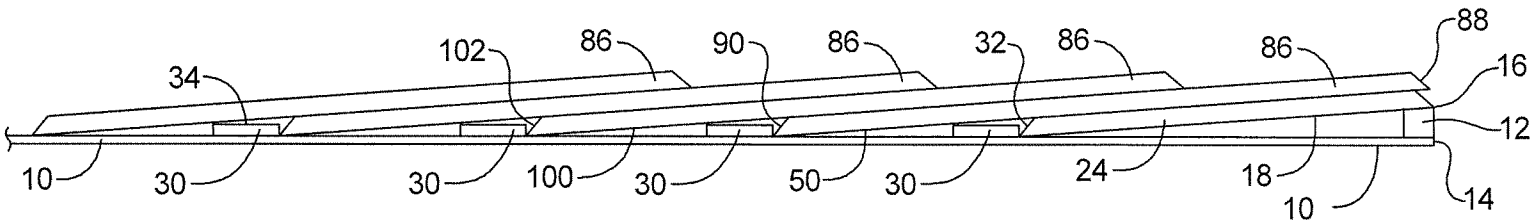
FIG. 7 is a schematic side view of a slate roof constructed in accordance with this disclosure, with the mounting hooks removed for clarity.

As seen in FIG. 1, the installation of a slate roof in accordance with this disclosure begins at the bottom edge or eve of a conventional roof 10, typically constructed of plywood sheets. To begin installation, a small wooden strip 12 (FIGS. 1 and 7), referred to as a cant strip, is nailed or otherwise attached to the lower edge 14 of roof 10. Cant strip 12 provides the initial elevation and spacing to the lower edge 16 of a first row 18 of slate tiles so as to match the angle or rise of the subsequent rows of slate tiles, as seen in FIG. 7.

After the cant strip 12 is installed, the bottom or first row 18 of slate eve tiles 24 is installed by conventional means, such as by hammer and nail. Tiles 24 are provided with punched holes for receiving copper or stainless steel roofing nails 26. Once the first row 18 of slate tiles is installed, an installation strip assembly 30 is securely butted against the top edge 32 of the first row 18 of slate tiles 24, as seen in FIG. 1. As used herein, the terms slate, tile, and slate tile all refer to and include rigid and semi-rigid roof covering members.

Figure 5:
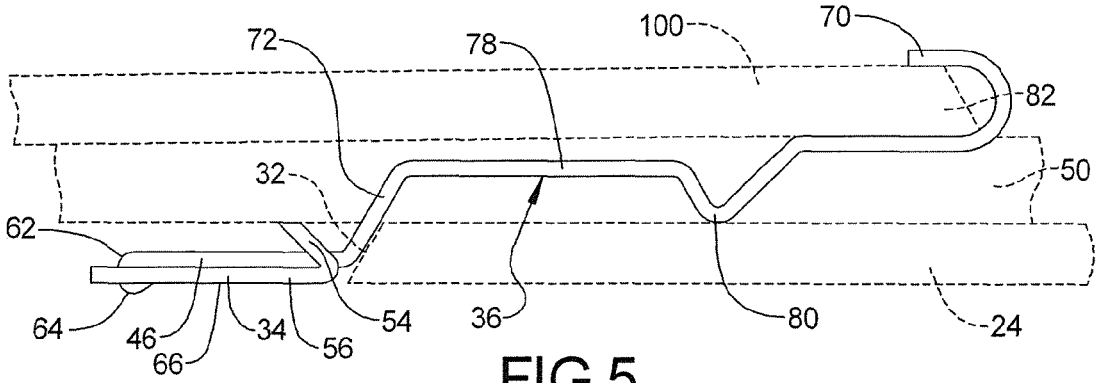
FIG. 5 is a partial side view of an installation strip and hook assembly of the type used in FIGS. 1 through 4 showing three layers of slate roofing tiles in dashed lines.
Figure 6:
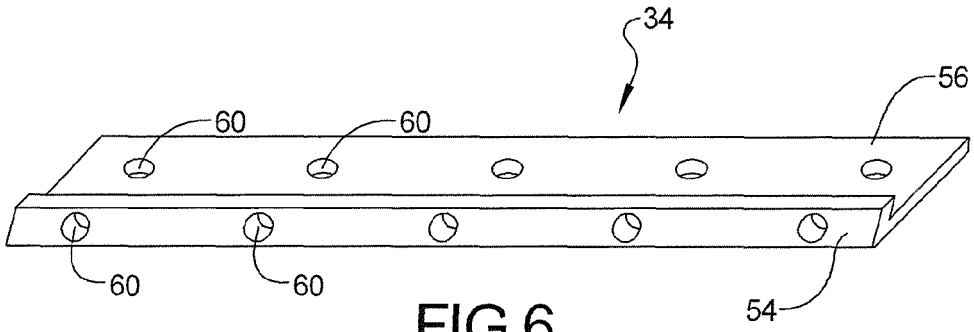
FIG. 6 is a perspective view of an installation strip prior to receiving mounting hooks.

Strip assembly 30 can be provided in virtually any suitable length, such as in three foot, six foot or even twelve foot lengths. As seen in FIGS. 1, 5 and 6, each strip assembly 30 is fabricated with two components. The first component is an elongated base strip 34 of thin sheet metal, such as 28 gauge stainless steel. The second component is an elongated hook 36 formed of, for example, copper wire or stainless steel wire.

The term "hook" is meant to include any form of retainer which can engage the lower or bottom edge of a tile. It is also possible to foam the base strip 34 and hook 36 of durable weather-resistant plastic materials. In one embodiment disclosed below, the base strip 34 may be fabricated from a flexible plastic or fabric sheet.

As further seen in FIGS. 1, 5 and 6, the hooks 36 are attached to the base strip 34 at predetermined selected regular intervals along the length of the base strip 34. In some applications, the hooks 36 can be unevenly or randomly spaced along the base strip 34. In one embodiment, the spacing between each adjacent pair of hooks 36 can be equal to or slightly greater than the width of the slate tiles installed in the second, third and subsequent rows, plus an allowance for a spacing or gap 37 between adjacent tiles, such as one quarter inch. Each hook 36 can extend a predetermined length or distance 38 below the lower abutment edge 40 of each base strip 34. In one embodiment, length 38 can be three inches.

Figure 8:
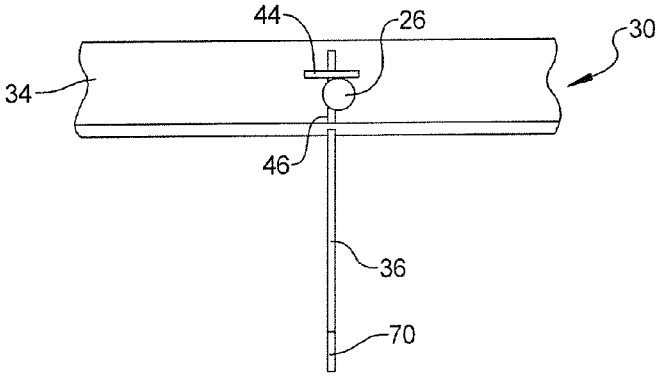
FIG. 8 is a partial top plan view of a portion of an installation strip and hook assembly fastened to a roof.

As seen in FIG. 8, the strip assembly 30 can be secured to the roof 10 with roofing nails 26 or with roofing staples 44 driven through the base strip 34 at any desired location and spacing. Additional strength and stability can be provided to each hook 36 by driving the head of the roofing nails 26 over the top end portion 46 of each hook 36 and through the base strip 34. Alternatively, roofing staples 44 can be driven across and over the top end portion 46 of each hook 36 as further shown in FIG. 8.

Once the first strip assembly 30 is secured to the roof 10 in abutting relation to the top edge 32 of the first row 18 of slate eve tiles 24, a second row 50 (FIG. 2) of slate tiles is aligned over the first row 18 of eve tiles 24. The second row 50 of slate tiles is also installed in a conventional manner with roofing nails 26. Each adjacent pair of slate tiles in the second row 50 is separated by a gap 37 through which a hook 36 projects upwardly from the first strip 30, such as shown in FIG. 5.

As further seen in FIGS. 5 and 6, each hook 36 is attached to a base strip 34 with a secure mechanical connection. Each base strip 34 is formed with a raised slanted lip or flange 54 and a planar sheet 56 which seats on the roof 10. Both the lip and sheet portions 54, 56 of the base strip 34 are formed with aligned holes 60 for receiving the top end portion 46 of each hook 36. The tip 62 of each hook 36 is formed with a short elbow or hook 64 which, after insertion through a hole 60 in sheet 56, is hammered or peened over rigidly against the underside 66 of sheet portion 56. This attachment securely positions the hook 36 in a plane substantially perpendicular to the plane in which the sheet 56 extends, so that the U-shaped free end portion 70 of the hook 36 projects upwardly from between adjacent slate tiles through gaps 37.

As further seen in FIG. 5, each hook 36 further includes an upwardly slanted or raised portion 72 that can abut against the top edge 32 of an adjacent slate tile. Raised portion 72 extends upwardly from the top end portion 46 adjacent the lip 54 on the base strip 34 and extends into a central hook portion 78 which is substantially parallel to the top end portion 46. The central portion 78 extends into a downwardly extending bend such as a U-shaped, V-shaped or elbow-shaped tile engagement portion 80 constructed and dimensioned to rest upon an adjacent slate tile against which strip assembly 30 is positioned.

The engagement portion 80 extends upwardly above the central portion 78 into the U-shaped or hook-shaped free end portion 70. As seen in FIG. 5, the free end portion 70 is dimensioned to securely receive, position and hold the bottom edge 82 of a slate tile.

Figure 14:
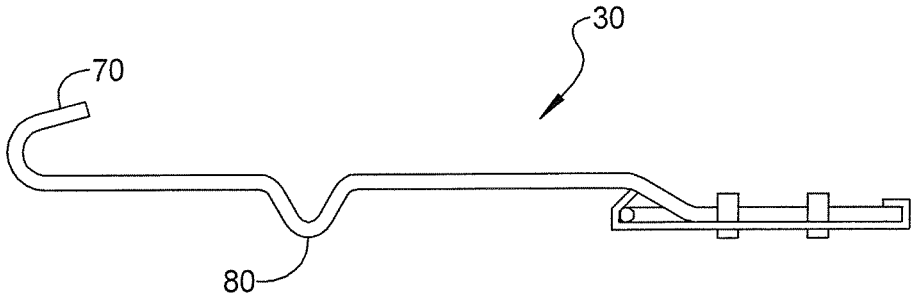
FIGS. 14 and 15 show an alternate embodiment of the hook of FIGS. 12 and 13, respectively.
Figure 16:
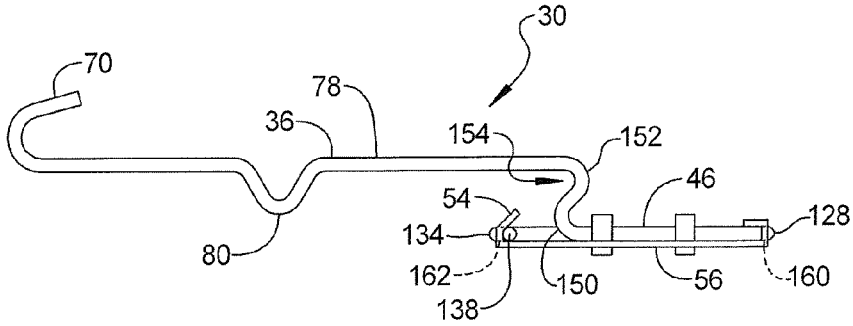
FIG. 16 is a view of an alternate construction of the installation strip assembly of FIG. 5 which can be used with the installation of FIGS. 1-4.
Figure 19:
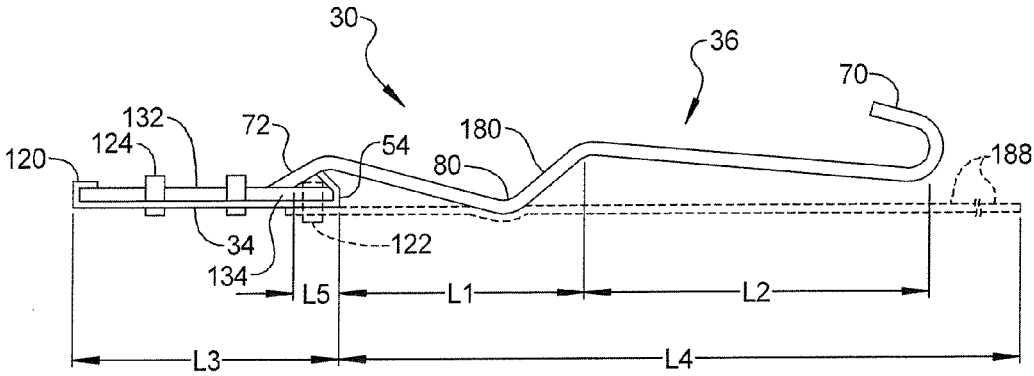
FIG. 19 is a side view of an alternate embodiment of an installation base and hook assembly with an optional integral weatherproofing sheet.

The tile engagement portion 80 can extend downwardly to different depths such as shown in FIGS. 14, 16 and 19. The further downward the tile engagement portion extends with respect to an underlying tile (and the base strip 34), the greater will be the vertical interference with the underlying slate tile, and the greater will be the spring biasing force applied by the tile engagement portion 80 against the upper surface of an underlying tile. This resilient spring force helps to retain a slate tile in place, yet allows the tile to "wobble" when stepped upon. This is important to reduce slate tile breakage when workers walk over the installed tiles.

Due to the inherent variations in the size, thickness and dimensions of slate tiles, there is typically a "loose fit" between adjacent tiles so that full planar contact is difficult to achieve. This uneven contact can result in contact points of stress concentration between adjacent slate tiles. If the tiles are rigidly fixed together, a worker stepping on the upper slate tile can cause the fixed tile to break at a stress concentration point. This is prevented with the leaf-spring biased retention provided by the hooks 36.

Returning now to FIG. 2, a "half slate" 84 having a width of about half the width of the adjacent "full tiles" 86 is nailed or fastened to the underlying roof 10 in a conventional manner. The half slate 84 is aligned evenly parallel or "flush" with one end or edge 87 of the roof 10. The adjacent slate full tiles 86 are aligned over the eve tiles 24 so that the lower edges 88 of the adjacent full tiles 86 are evenly aligned over or parallel with the lower edge of roof 10 and over or parallel with the lower edges 16 of the eve slate tiles 24, such as seen schematically in FIG. 7.

Figure 2:
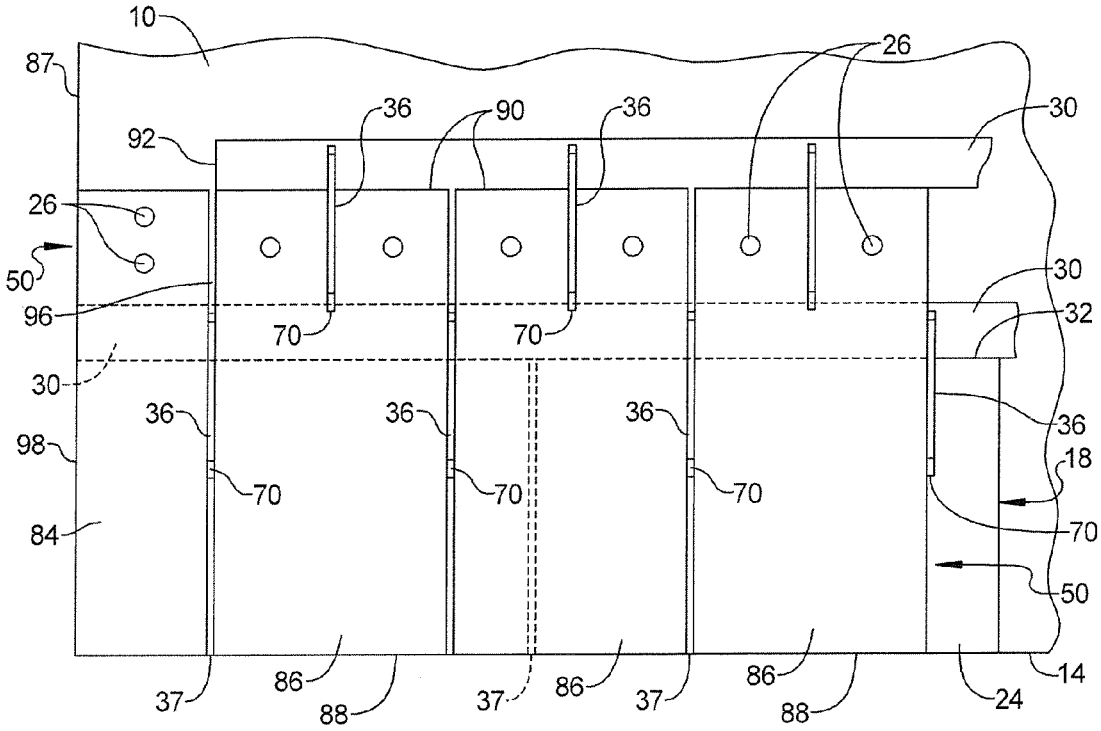
FIG. 2 is a partial top plan view of a second row or course of slate roofing tiles installed over the first course of FIG. 1.

As further seen in FIGS. 2 and 5, the hooks 36 on the bottom or first strip assembly 30 extend between and project in part above the eve tiles 24. That is, due to the engagement of the engagement portion 80 with the top surface of the eve tiles 24, the central portion 78 and the free end portion 70 of each hook 36 overlies the eve tiles 24.

Once the second row 50 of slate tiles is installed, a second assembly strip 30 is positioned and abutted along the top edges 90 of the full slate tiles 86. Strip 30 is then attached, nailed or stapled to the roof 10 as noted above with respect to the first assembly strip 30. However, one end 92 of the second strip assembly 30 is aligned with the edge 96 of the first full slate tile 86 adjacent the half slate 84. This spaces the second strip assembly 30 about one half width of a full tile 86 from the edge 87 of roof 10 and/or the outer edge 98 of the half tile 84.

Figure 3:
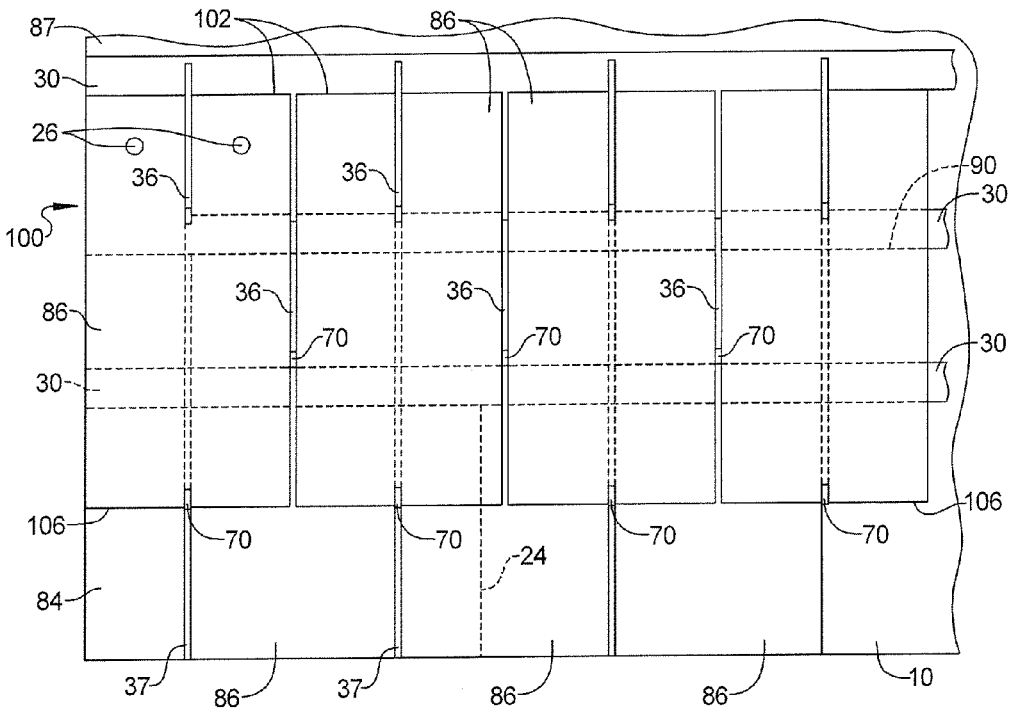
FIG. 3 is a partial top plan view of a third row or course of slate roofing tiles installed over the second course of FIG. 2.

The next step in the installation of a slate tiled roof is shown in FIG. 3. In this step, a full slate tile 86 is layered over the underlying two rows 18, 50 of tiles along the edge of the roof 10 and inserted into the U-shaped free end portion 70 of hook 36 on the first installed or lowest installation strip assembly 30. This first full slate tile 86 is formed with punched holes and is nailed to roof 10 with roofing nails 26. The remaining tiles 86 in this third row 100 are simply inserted into a hook-shaped free end portion of a projecting hook 36 and aligned between an adjacent pair of projecting hooks 36 as seen in FIG. 3.

It should be noted that when each row 18, 50, 100 etc reaches the opposite edge of the roof of the opposite end of a respective row, the same or similar arrangement of nail-mounted half slates 84 and nail-mounted full slates can be employed to complete each row. It can be appreciated that once an installer completes the first and second rows 18, 50 of nail-installed tiles and nails the first half slate 84 or full slate 86 along the edge 87 of roof 10, the remaining full tiles 86 in each row can be quickly and easily installed by inserting each tile 86 between a pair of hooks 36 and into a hooked free end portion 70 on a lower row of hooks 36. That is, as seen in FIG. 3, no further nailing is required until the installer reaches the opposite end of the row.

Once the third row 100 is installed as noted above, a third installation strip assembly 30 is positioned against the upper edges 102 of the tiles 86 in the third row and nailed in place as discussed above with respect to the first and second installation strip assemblies 30. As seen in FIGS. 3 and 5, the hooks 36 not only locate and hold the lower or bottom edges 106 of the tiles 86 in place, the hooks 36 also press down on the upper surface of the underlying tiles to more firmly hold each tile in place. Moreover, the weight of the tiles overlying each hook 36 press each hook 36 against the upper surface of the tile located beneath each hook. This is shown in FIG. 5, where the elbow-shaped engagement portion 80 is pushed or pressed onto the bottom tile by the weight of the upper tile. Additional weight is applied by additional tiles installed over the upper tile as shown in FIG. 7.

Figure 4:
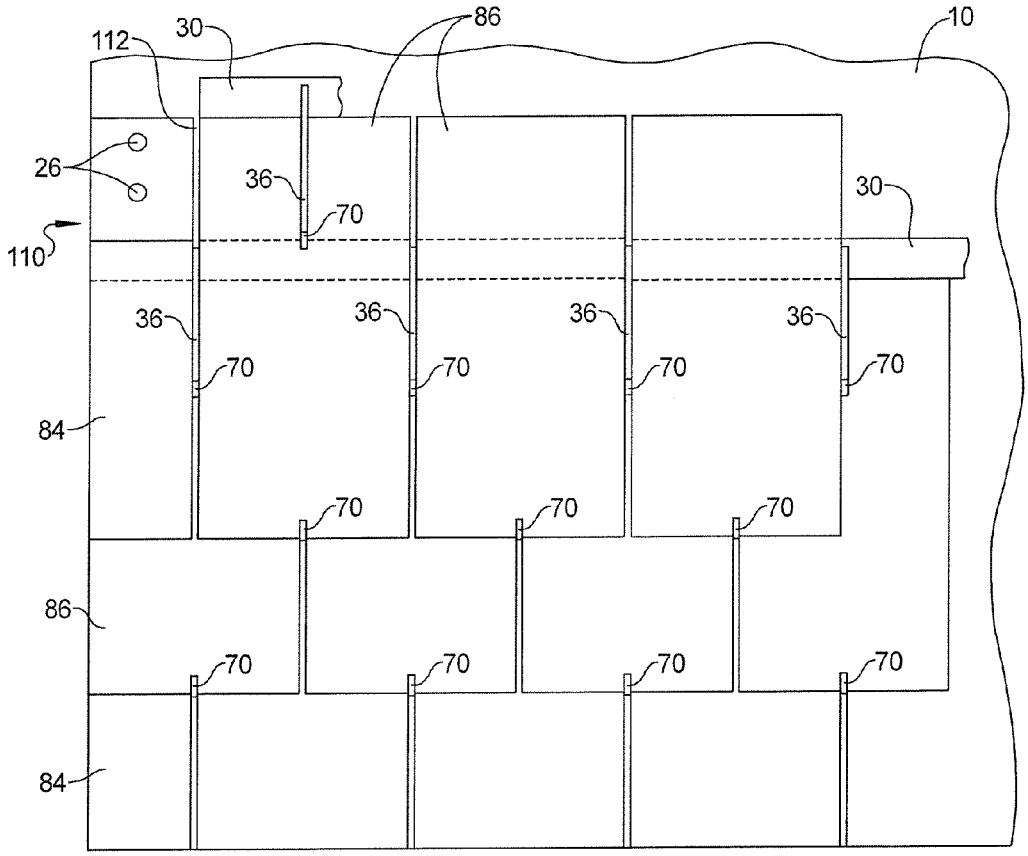
FIG. 4 is a partial top plan view of a fourth row or course of slate roofing tiles installed over the third course of FIG. 3.

As shown in FIG. 4, a half slate 84 is nailed to roof 10 as described above and a fourth row 110 of tiles is installed in the same fashion as the third row 100. An installation strip 30 is then positioned in line with the edge 112 of the first full slate 86 adjacent the half slate 84. It can be further seen in FIG. 4 that the slate tiles 86 are positioned and held laterally between a pair of adjacent hooks 36 and held with vertical support along the bottom edge with a single central hook free end portion 70.

This alternating pattern of half slates 84 and full slates 86 along the side edges of roof 10 on adjacent rows of tiles is repeated until reaching the top of the roof. At this point, a conventional cap structure is installed using known techniques.

The installation system described above can be used with virtually any size of slate tile. In one embodiment, the wooden cant strip 12 can be ⅝ inch high by ⅞ inch wide. The eve slates 24 can be 7½ inches high by 12 inches wide. The half slates 84 can be 3 inches wide and 12 inches high and the full slates 86 can be 12 inches high and 6 inches wide. The installation strip planar sheets 56 can be 1¼ inch high and provided in any desired length. Strips 30 can be cut with tin snips or metal shears to any desired length to fit any particular row length.

Figure 9:
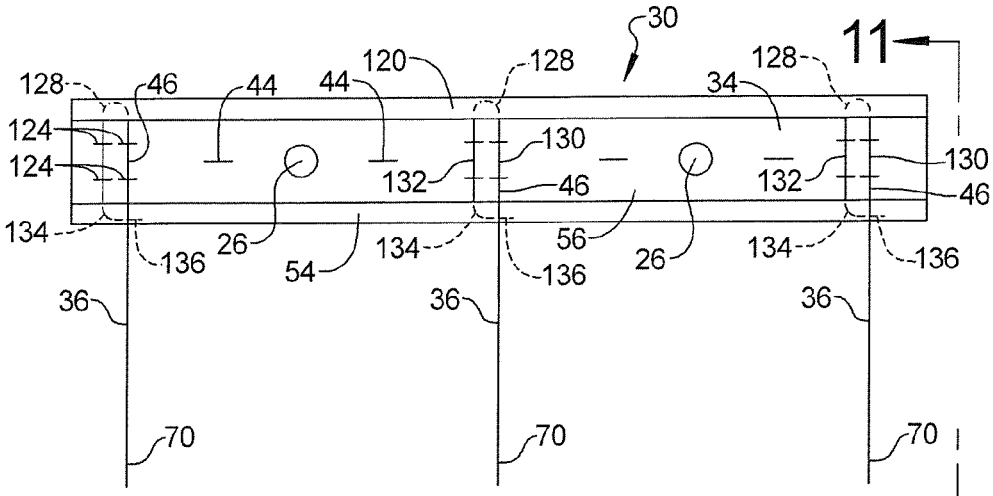
FIG. 9 is a top plan schematic view of an alternate embodiment of an installation strip and hook assembly.
Figure 10:
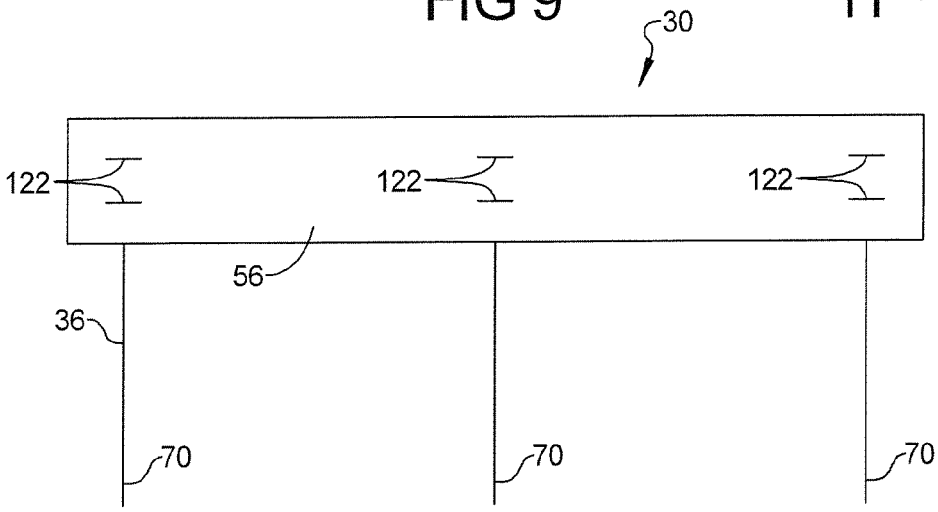
FIG. 10 is a rear view of FIG. 9.
Figure 11:
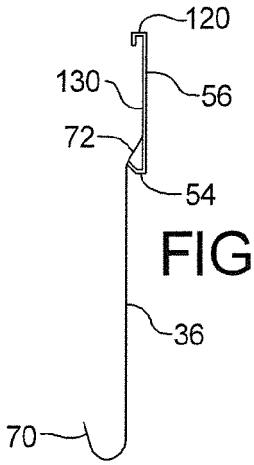
FIG. 11 is a side view of FIG. 9 taken along line 11-11 thereof.
Figure 12:
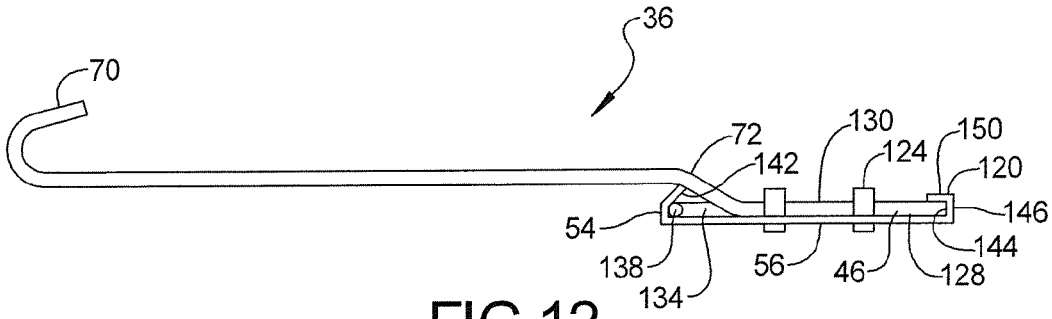
FIG. 12 is an enlarged view of FIG. 11.

Another embodiment of strip assembly 30 is shown in FIG. 9 wherein base strip 34 is formed as a plastic extrusion about one millimeter in thickness. One suitable plastic material is high density polyethylene. The base strip 34 can be formed with any length or cut to size on a job site. The height of the strip can be one inch, one and a quarter inch, and one and a half inch or more. The base strip 34 is formed with a lower lip or flange 54, a planar central sheet portion 56 and an upper lip or flange 120.

As further seen in FIG. 9, one or more elongated hooks 36 are carried on the base strip 34. These hooks can be used with a different installation system from that described above with respect to FIGS. 1-4. For example, the hooks described and shown in FIGS. 9-13 can be used with a commercially available installation system which employs a minimal overlap between adjacent slate tiles, such as shown schematically in FIG. 17. As discussed further below, the hooks 36 can be permanently fastened to the plastic base strip 34 or can be removably mounted to the base strip with a spring-biased mounting. The spacing between the hooks can be uniform or variable. Roofing nails 26 or roofing staples 44 can be used to secure the base strip 34 to a roof 10.

The hooks 36 in FIGS. 9-13 are shown permanently fixed to the base strip 34 with short staples 122 driven through the back of each base strip 34. The short arms 124 of each staple 122 are tightly curled over each hook 36 as described further below. Additional strength, stability and structural integrity can be achieved by forming each hook 36 with an upper curved shoulder portion 128 and a pair of substantially parallel and coplanar stabilizing portions 130, 132 which lie securely against the planar sheet portion 56.

Figure 13:
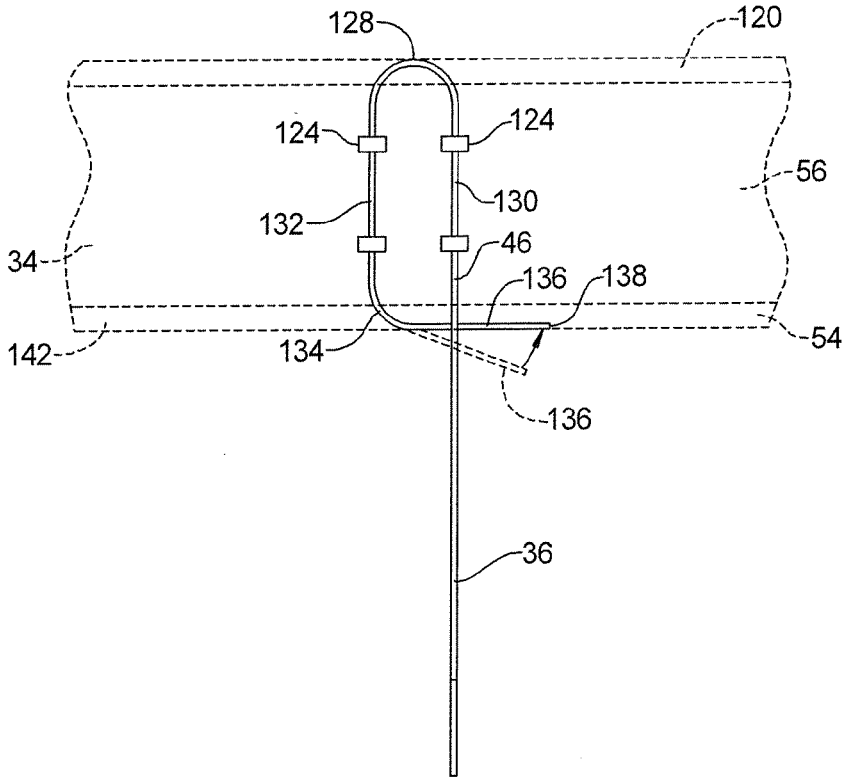
FIG. 13 is a top plan view of the hook of FIG. 12.

Still further strength and stability can be provided to the mounting of the hooks 36 to the base strip 34 by forming an elbow 134 on stabilizing portion 132 and bending the free end portion 136 transverse, across and under the top end portion 46 of each hook 36 (FIG. 13). In the examples shown, the free end portion 136 and its tip 138 are snuggly pressed against the inner surface of the lower flange 54 so as to nest securely within the groove or channel 142 (FIG. 12) defined by the lower overhanging flange 54.

Figure 15:
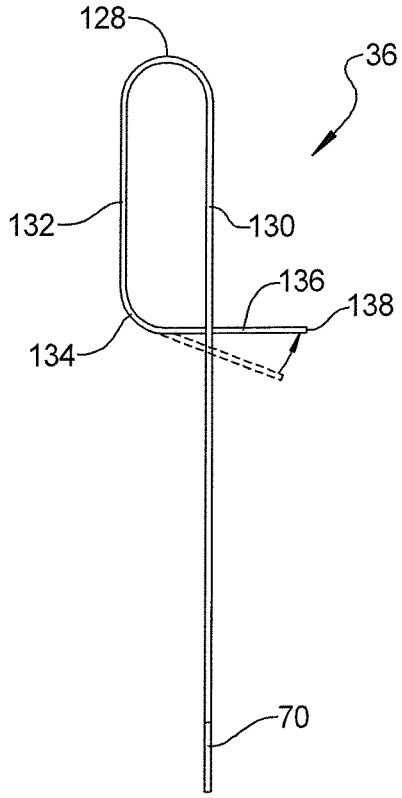

The upper lip or flange 120 also defines a channel 144 for receiving the upper shoulder 128 of each hook 36. Channel 144 is defined by an end wall 146 projecting upwardly from the planar portion 56 of base strip 34 and an overhanging lip portion 150. Shoulder 128 fits snugly within channel 144 by a wedged interference fit. Additional biasing force and stability can be applied between the base strip 34 and the hooks 36 by forming the free end portion 136 as shown in dashed lines in FIGS. 13 and 15 and elastically bending it over the lower lip or flange 54 and allowing it to snap into channel 142.

This forces the upper shoulder into channel 144 and the free end portion 136 into channel 142. In some applications, this snap fit mounting can be all that is required to hold the hooks 36 to the base strip 34. That is, the staples 124 can be eliminated and the hooks 36 can be mounted in the factory or on the job site by an installer using no tools. In this embodiment as well as in other embodiments, the hooks 36 can be formed of metal wire 1, 2, 3 or more millimeters in diameter or of resilient plastic wire.

Figure 17:
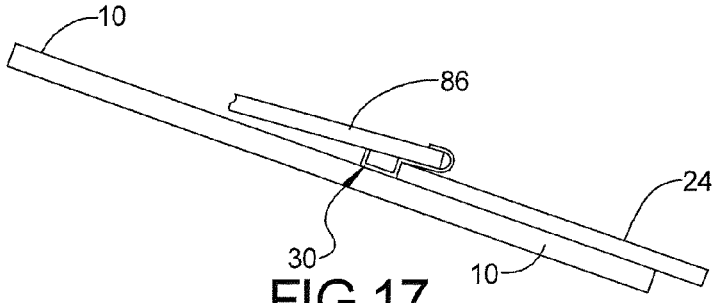
FIG. 17 is a schematic side view of an alternate slate roof construction wherein the slate tiles are installed with a minimum overlap.

The hook 36 of FIGS. 9-13 does not include the elbow-shaped engagement portion 80 as shown in FIG. 5. This modified hook of FIGS. 9-13 can be used with conventional roofing systems which use a very short overlap between overlying and underlying tiles, with only two or three inches of one tile overlapping a single underlying tile as shown in FIG. 17.

However, as seen in FIG. 14, this second embodiment of FIGS. 9-13 can be modified with a hook 36 similar to the type shown in FIG. 5 and used with the system of FIGS. 1-4.

Figure 18:
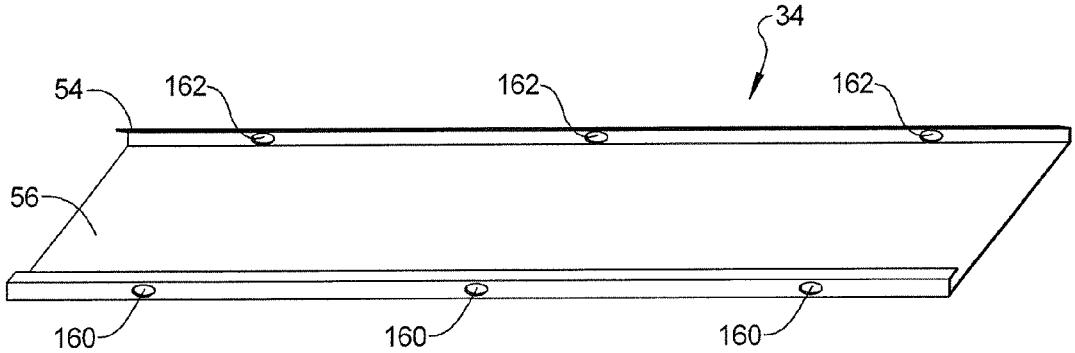
FIG. 18 is a top perspective view of an alternate design of an installation base strip formed with hook mounting holes.

Another embodiment of the installation strip assembly 30 is shown in FIGS. 16 and 18. This embodiment is compatible with the installation system of FIGS. 1-4. In this embodiment, the top end portion 46 transitions into a reverse bend 150 which extends upwardly and rearwardly to a forward bend 152 which together define a serpentine section 154. Section 154 provides a raised or vertical spring for resiliently accommodating the variations in slate tile thickness and size.

As further seen in FIGS. 16 and 18, the base strip 34 can be provided with anchoring and positioning holes 160 along and through end wall 146 and optionally through the holes 162 in the lip or flange 54. As seen in FIG. 16, the upper curved shoulder portion 128 of the hook 36 can extend into or through a hole 160 to fix the hook 36 in a predetermined position on the base strip 34. Likewise, the elbow 134 of hook 36 can extend into or through a positioning hole 162.

Another variation of the installation strip assembly 30 is shown in FIGS. 19-22. This installation strip assembly 30 is adapted for use with commercially available slate roof installation systems of the type represented in FIG. 17. In this embodiment, the hook 36 has a U-shaped, V-shaped or elbow-shaped tile and slate engagement portion 80 for engaging the top edges 170 (FIGS. 21 and 22) of the preceding row of slate tiles 172.

That is, in this embodiment, the arm 180 of the slate engagement portion 80 prevents the upward movement of the preceding row of slate tiles and thereby vertically "locks" the preceding row of tiles in place on the roof 10. This is best seen in FIGS. 21 and 22.

In the embodiment represented by FIG. 19, the distance L1 between the flange 54 and the top of arm 180 is about one inch. The distance L2 between the top of arm 180 and the end of hook 36 is about two inches. The width (or height) L3 of the base strip 34 is about one and one half inch.

Figure 20:
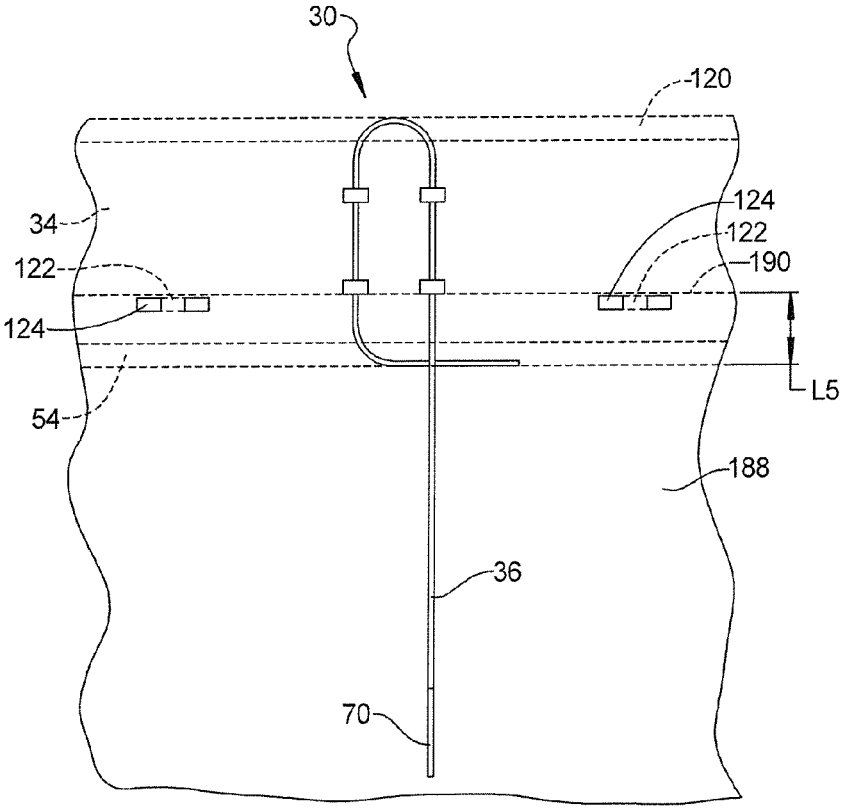
FIG. 20 is a partial top plan view of FIG. 19.
Figure 22:
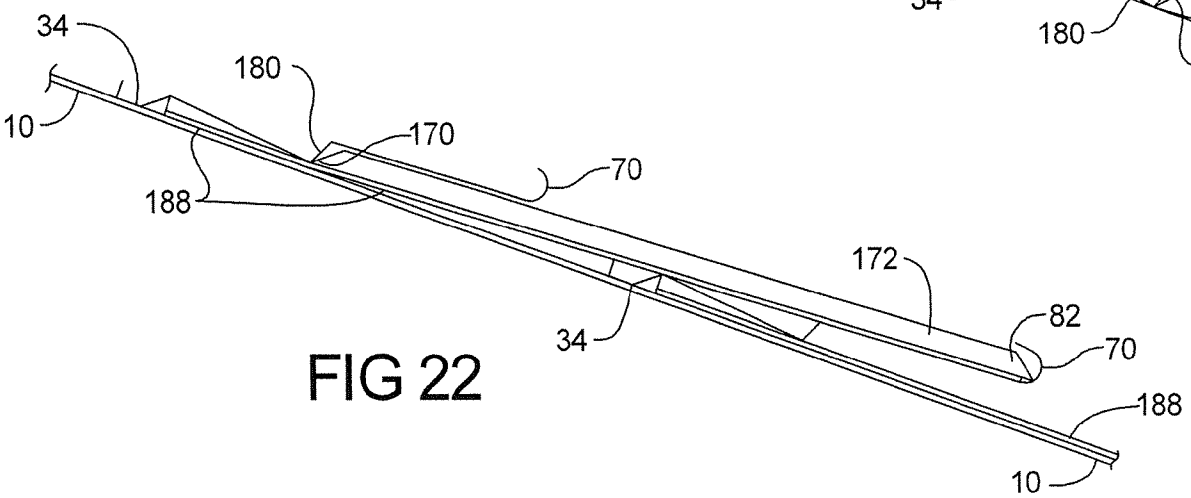
FIG. 22 is a view similar to FIG. 21 wherein the installation and hook assembly includes a weatherproofing sheet.

As further shown in dashed lines in FIG. 19 and in solid lines in FIGS. 20 and 22, an optional weatherproofing sheet 188 of durable plastic such as high density polyethylene is fixed to the bottom of the base strip 34, such as with staples 122. The free length L4 of the weatherproofing sheet 188 is about 12¾ inches long in this example, with about an additional one fourth inch (L5) extending under the base strip 34 to the upper edge 190 of the weatherproofing sheet 188 making the total length about 13 inches. The weatherproofing sheet 188 forms a barrier against moisture so as to protect the underlying roof 10 against rain, snow, ice, wind blown dust and dirt and sunlight.

Figure 21:
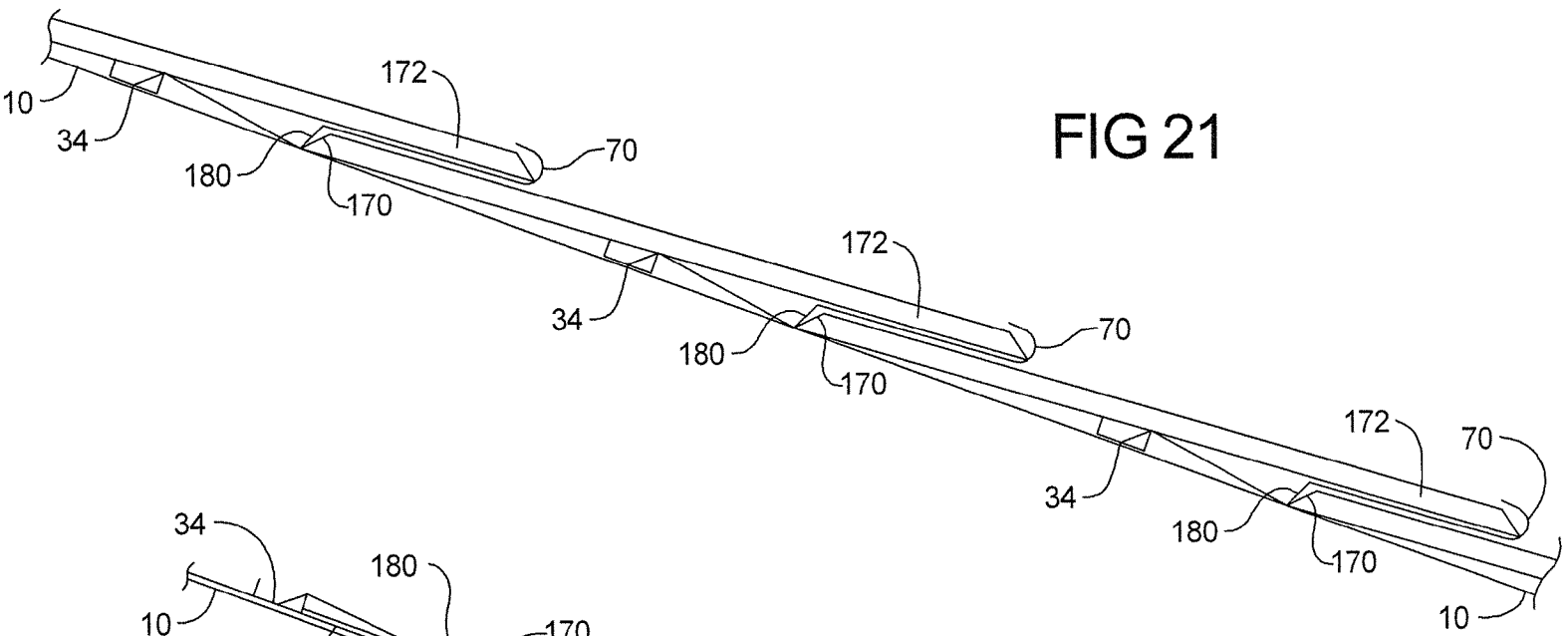
FIG. 21 is a schematic side view of the installation and hook assembly of FIG. 19 without a weatherproofing sheet mounted to a roof.

As seen FIG. 21, the optional weatherproofing sheet 188 is omitted and as seen in FIG. 22, the weatherproofing sheet 188 is installed on the base strip 34. Sheet 188 can extend up to about the bottom edge 82 of the preceding row of slate tiles 172.

Figure 25:
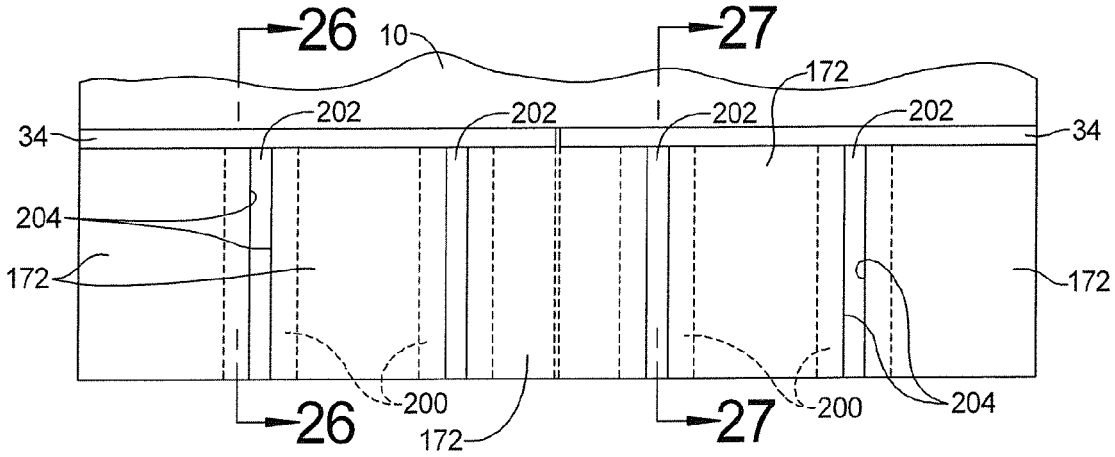
FIG. 25 is a view of FIG. 24 with a row of slate tiles mounted over the weatherproofing sheets and over the protective strips.
Figure 26:
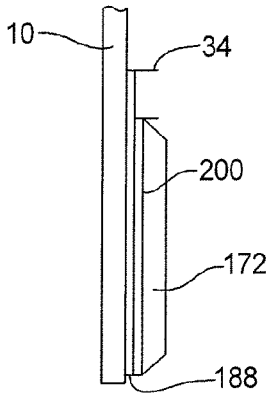
FIG. 26 is a view in section taken through section line 26-26 of FIG. 25.
Figure 27:
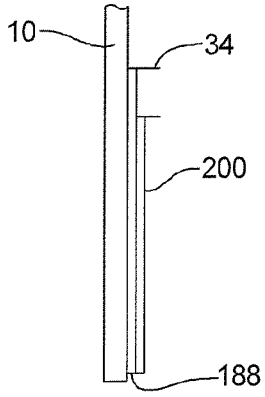
FIG. 27 is a view in section taken through section line 27-27 of FIG. 25.

Portions of the weatherproofing sheet 188 in this example can be directly exposed to the ambient environment and subject to degradation from exposure to sunlight (UV light), as well as abrasion from wind blown dirt and dust particles, and dirt laden rain. This harsh exposure erodes and wears a channel through the weatherproofing sheet 188 located under the gap 202 (FIG. 25) formed between adjacent tiles 172.

Instead of increasing the thickness of the weatherproofing sheet 188 or using two coextensive layers of conventional thickness to increase the useful life of the bottom weatherproofing sheet 188, it has been found that the useful life of the underlying weatherproofing sheet 188 can be significantly increased by locating a relatively thin strip of material over the weatherproofing sheet 188 along and under the gap or slot 202 formed between adjacent tiles 172.

Figure 23:
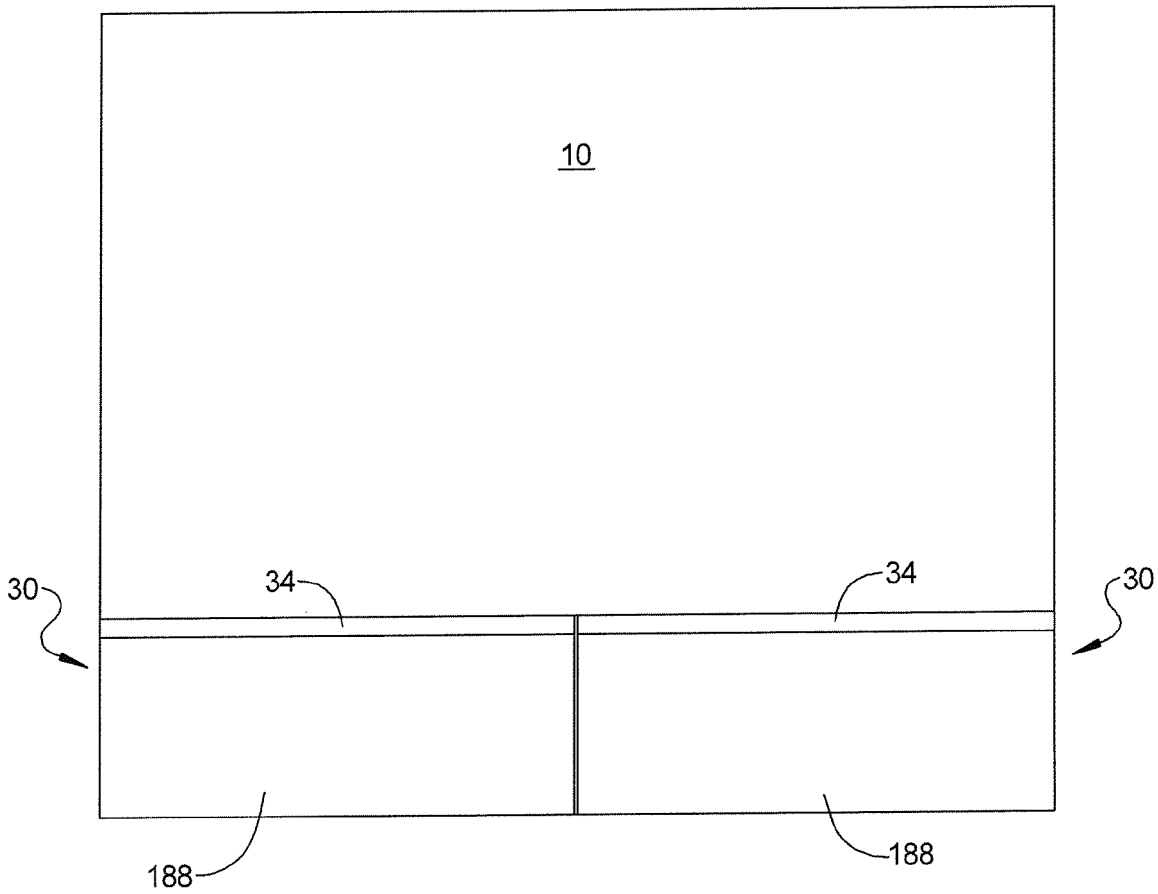
FIG. 23 is a top plan view of a pair of installation and hook assemblies with integral weather proofing sheets mounted on a roof.

That is, a thin strip of plastic, thin metal foil such as stainless steel, copper or other relatively inert metals can be superposed over the underlying weatherproofing sheet 188 along the gap or crack 202 defined between juxtaposed tiles. For example, as shown in FIGS. 23-27, two installation strip assemblies 30, such as shown in FIGS. 19 and 20, are initially installed on a roof 10, with integral or separately installed weatherproofing sheets 188 covering the roof 10 where a row of slate tiles 172 is to be installed (FIG. 23). The hooks 36 have been omitted from FIGS. 23-27 to simplify these views.

Figure 24:
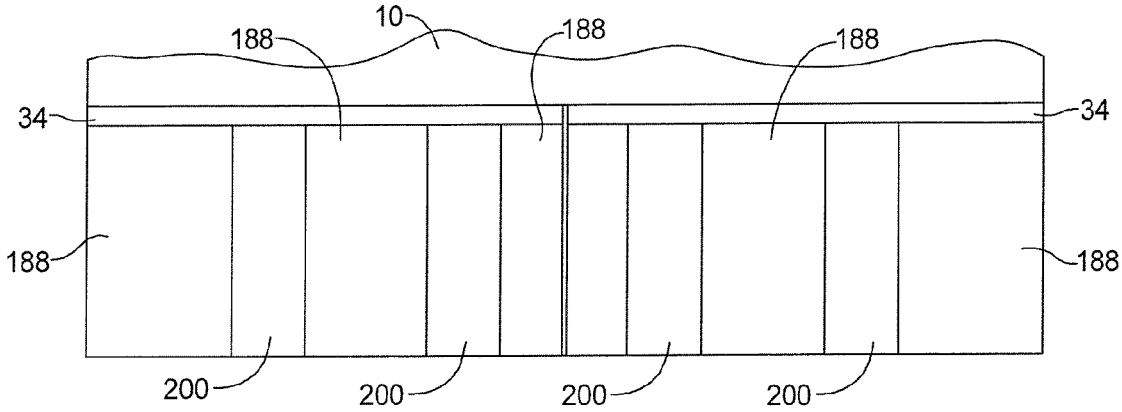
FIG. 24 is a partial view of FIG. 23 with a series of protective strips positioned on top of the weatherproofing sheets.

Next, as seen in FIG. 24, a series of spaced-apart secondary protective strips 200 is placed over the underlying primary weatherproofing sheet 188 at locations centered along the gaps 202 (FIG. 25) formed between each side wall 204 of each pair of juxtaposed tiles 172. Strips 200 can be preassembled and premounted to each installation strip 30, such as by stapling or gluing or can be separately installed during the tile roof installation process.

Figure 28:
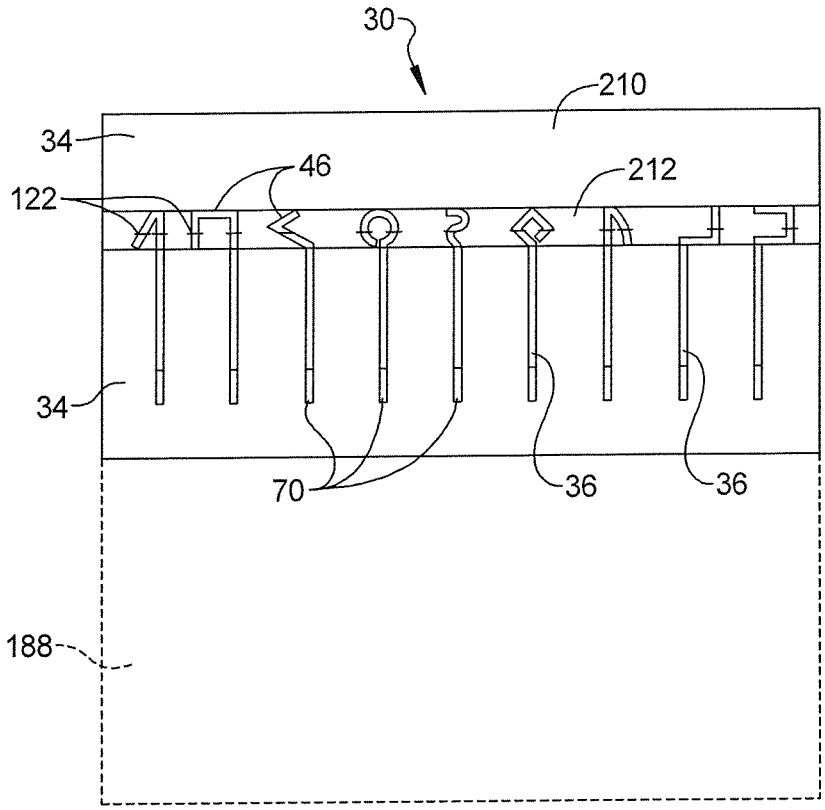
FIG. 28 is a top plan view of an alternative embodiment of a flexible and rollable installation strip and hook assembly and showing examples of different shaped hooks.
Figure 29:
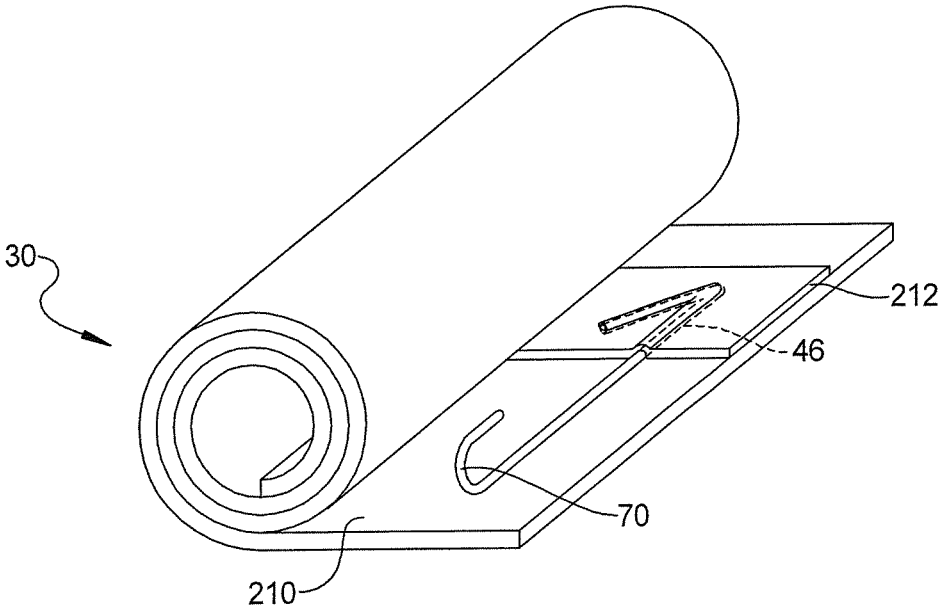
FIG. 29 is a perspective view of the assembly of FIG. 28 rolled into a scrolled configuration.

Another embodiment of the installation strip and hook assembly 30 is shown in FIGS. 28 and 29. In this example, a flexible sheet of plastic or fabric material 210 serves as a backing and base strip 34 upon which a series of hooks 36 is attached. As seen in FIG. 28, the top end portion 46 of each hook 36 can be formed with any number of different planar configurations for attachment to the planar sheet material 210. These configuration of the top end portion 46 can also be adapted for use in the previously described embodiments. The top end portions 46 of each hook 36 can be attached to the sheet material 210 with staples 122, with stitching, with an adhesive or glue, or with adhesive tape 212 secured to the sheet material 210. Single or double-sided adhesive tape can be used effectively to attach the hooks to the sheet material. Other conventional attachment methods can be used.

As seen in FIG. 29, the installation strip and hook assembly can be rolled into a compact scroll for compact shipping, storage and for easy handling. The scrolled assembly 30 can be placed on a roof surface and easily unrolled such as shown in FIG. 28. Once unrolled, the assembly can be used for mounting slate tiles generally as described above.

The flexible sheet 210 can be formed of a single weatherproofing sheet 188 as described above and shown as an extension of sheet 210 in dashed line in FIG. 28.

Figure 30:
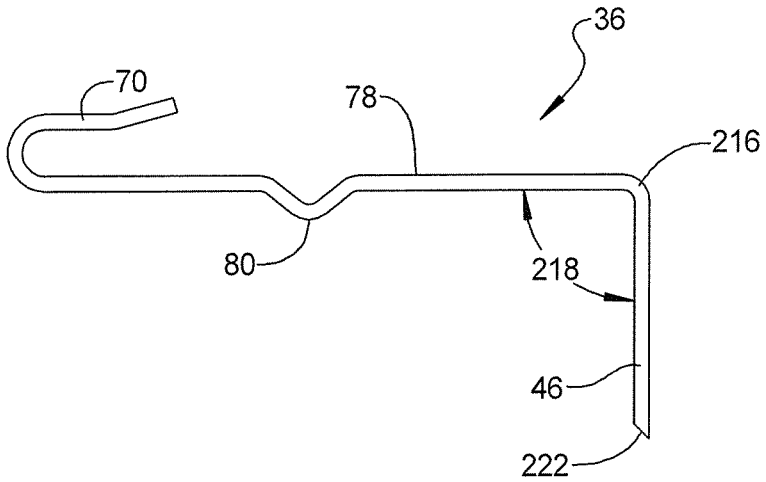
FIGS. 30 and 31 are side elevation views of alternate embodiments of a hook that can be used without a base strip.
Figure 31:
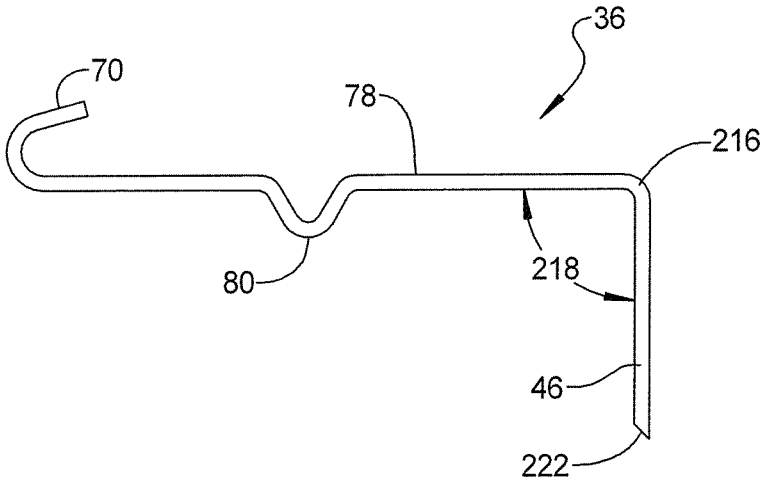

As seen in FIGS. 30 and 31, hooks 36 can be formed as stand-alone fasteners without a base strip 34. Each hook 36 is formed with a downward bend 216 in their central portion 78. The end portions 46 can extend downwardly at an included angle 218 of about 90° or less. The free ends 222 of the end portions 46 can be formed with sharp points such as chisel-shaped ends for hammering into a roof in a known fashion. These hooks can be used effectively with conventional hammer and nail slate tile roof installations. The bend portions 80 provide a desired spring-biased installation force as noted above, and further promote the "wobble" between installed tiles when the tiles are stepped upon.

There has been disclosed the best embodiment as presently contemplated. Numerous modifications and variations of the disclosure are possible in light of the above teachings. It is therefore to be understood that within the scope of the disclosure, the concepts methods and systems may be practiced otherwise than as specifically described above. For instance, the installation system can be used with tiles made of ceramic or other roofing tile material. In addition, the hooks 36 can be secured to the base strip 34 with an adhesive such as epoxy glue adhesive. A particularly effective epoxy for this application is an ultra-violet-light cured epoxy or adhesive.

What is claimed is:

1. An installation assembly for slate and tile roofs, comprising:

an elongated base strip extending in a plane;

a plurality of hooks permanently assembled on said base strip; and wherein each of said plurality of hooks comprises a mounting portion permanently fixed in a predetermined position on said base strip, a central portion extending from said base strip and a hook-shaped free end portion extending from said central portion and defining an open mouth portion for receiving a tile, said central portion comprising an elbow-shaped tile engagement portion disposed between said mounting portion and said open mouth portion and bending downwardly toward said plane and away from said mounting portion and upwardly toward said open mouth portion.

2. The assembly of claim 1, further comprising a staple fixing each one of said plurality of hooks to said base strip.

3. The assembly of claim 1, wherein said base strip comprises sheet metal.

4. The assembly of claim 1, wherein said base strip comprises a plastic strip.

5. The assembly of claim 1 wherein said plurality of hooks is spaced apart at regular intervals along said base strip.

6. The assembly of claim 1, wherein said plurality of hooks comprises a plurality of wire hooks.

7. The assembly of claim 1, wherein said base strip comprises a planar sheet portion and a lip portion raised above said planar sheet portion and engaging said plurality of hooks.

8. The assembly of claim 1, wherein said base strip comprises a plastic extrusion having a planar central sheet portion having a lower portion and an upper portion, a lower lip on said lower portion and an upper lip on said upper portion, and wherein each one of said plurality of hooks comprises a stabilizing portion held between said upper lip and said lower lip.

9. A slate roof system, comprising:

a first row of slate tiles installed on a roof;

a second row of slate tiles installed on a roof over an upper portion of said first row of slate tiles;

a first mounting strip positioned adjacent an upper portion of said first row of slate tiles;

a plurality of first hooks provided on said first mounting strip, one of said plurality of first hooks aligned over one of said slate tiles in said first row;

a second mounting strip positioned adjacent an upper portion of said second row of slate tiles:

a plurality of second mounting hooks provided on said second mounting strip, with one of said plurality of second mounting hooks aligned over one of said slate tiles in said second row;

wherein one of said slate roof tiles in said second row is laterally aligned in position on said roof between two of said first hooks and wherein one of said second hooks engages a top surface portion of said one of said slate tiles in said second row of tiles;

wherein said one of said second hooks is aligned over and biased against a central upper portion of said one of said slate tiles in said second row of slate tiles; and wherein said two of said first hooks extend upwardly above said two of said slate tiles in said second row for respectively receiving two tiles in a third row of tiles positioned above said second row of tiles.

* * * * *